United States Patent [19]

Moser

[11] Patent Number: 4,942,931

[45] Date of Patent: Jul. 24, 1990

[54] DRILLING TOOL HAVING FRICTIONALLY ROTATABLE DRILLING HEAD

[75] Inventor: Bernhard Moser, Altshausen, Fed. Rep. of Germany

[73] Assignee: Hawera Probst GmbH & Co., Ravensburg, Fed. Rep. of Germany

[21] Appl. No.: 359,635

[22] Filed: May 31, 1989

[30] Foreign Application Priority Data

Jun. 18, 1988 [DE] Fed. Rep. of Germany ..... 3820697

[51] Int. Cl.[5] ..... E21B 10/44; E21B 17/22

[52] U.S. Cl. ..... 175/323; 175/394

[58] Field of Search ..... 175/394, 323, 320

[56] References Cited

U.S. PATENT DOCUMENTS

| | | | |
|---|---|---|---|
| 2,790,623 | 4/1957 | Pate et al. | 175/394 X |
| 3,888,320 | 6/1975 | Maxwell | 175/394 |
| 4,699,226 | 10/1987 | Müller et al. | 175/394 X |

FOREIGN PATENT DOCUMENTS

| | | |
|---|---|---|
| 0201723 | 11/1986 | European Pat. Off. . |
| 0264657 | 4/1988 | European Pat. Off. . |
| 1770951 | 1/1958 | Fed. Rep. of Germany . |
| 2543578 | 4/1977 | Fed. Rep. of Germany . |
| 2639310 | 3/1978 | Fed. Rep. of Germany . |
| 3044775 | 7/1982 | Fed. Rep. of Germany . |
| 3405070 | 8/1985 | Fed. Rep. of Germany . |
| 3426977 | 1/1986 | Fed. Rep. of Germany . |
| 3614010 | 11/1987 | Fed. Rep. of Germany . |
| 3635538 | 4/1988 | Fed. Rep. of Germany . |
| 2088437 | 6/1982 | United Kingdom . |

OTHER PUBLICATIONS

European Search Report of Oct. 26, 1989, for European Application EP 89 10 9302.

*Primary Examiner*—Stephen J. Novosad
*Attorney, Agent, or Firm*—Spencer & Frank

[57] ABSTRACT

A drilling tool is proposed which is preferably suitable for making apertures in concrete work or masonry is fissured rock. To avoid damaging an interchangeable conveying helix (4), the connection between the conveying helix (4) and drilling head (3) is made as a frictional-resistance connection (FIG. 2).

10 Claims, 3 Drawing Sheets

DRILLING TOOL HAVING FRICTIONALLY ROTATABLE DRILLING HEAD

DESCRIPTION

The invention relates to a drilling tool having a drill head axially supported by an interchangeable conveying helix.

Drilling tools with interchangeable conveying helices are primarily used for making apertures while using electrically or pneumatically driven hammer drills. In these tools, the carbide-tipped drilling head is designed as a cross drilling head or solid drilling head. Tools of this type are shown, for example, in German Offenlegungsschrift 2,639,310, German Offenlegungsschrift 3,044,757 or German Offenlegungsschrift DE 2,543,578A1.

European patent 0,264,657A1, a counterpart to U.S. Pat. No. 4,852,670, and to Federal Republic of Germany Offenlegungsschrift 3,635,538 has disclosed a drilling tool having an interchangeable conveying helix in which a coil spring is provided between conveying helix and axial supporting ring, which coil spring permits certain axial play of the conveying helix relative to the drill shank. The conveying helix can move away from the drilling head against the force of the spring and can also fully rotate freely relative to the drilling head or the drill shank in particular in the event of jamming or tilting of the helix in the drilled hole. Destruction of the plastic helix can thereby be avoided.

The contact force, produced by the supporting spring, between the conveying helix and the drilling head depends on the loading capacity of the plastic helix. If the contact force is set very high, the conveying helix is axially displaced and thus the positive-locking connection between conveying helix and drilling head is separated only during very high loading as a result of tilting or jamming. But this can lead to premature destruction of the conveying helix. Conversely, the contact force must be at least so large that there is always good positive locking between conveying helix and drilling head to bridge the play provided for the conveying helix.

As a result of the drilling-dust grooves which are contained in the drilling head and in which the conveying helix is generally anchored in a positive-locking manner, the effective contact-pressure area or connecting area of the positive-locking connection between conveying helix and drilling head is kept relatively small. Here, therefore, high surface pressures and thus increased stress on the conveying helix occur. Furthermore, in the known arrangement, during sudden stressing of the conveying helix caused by jamming or tilting, the positive-locking connection is subjected to exceptionally high impact loading, since the axial displacement for bridging the play provided cannot make a sudden adjustment. This can also result in premature destruction or fracture of the conveying helix.

The object of the invention is to improve a drilling tool of the type described above to the effect that the conveying helix is exposed to less forces in operation so that the wear on the conveying helix and thus the risk of fracture is reduced.

Starting from a drilling tool of the type designated at the beginning this object is achieved by the provision of a spring-loaded conveying helix pressing against, supporting, and rotating a drilling head through frictional forces. Advantageous and convenient further development of the invention are as specified below.

Compared with known devices, the drilling tool according to the invention has the advantage that the life in particular of a plastic conveying helix can be considerably increased in certain applications. According to the invention, no provision is made for an otherwise customary positive-locking connection between conveying helix and drilling head, but rather provision is made for a frictional-resistance connection. In this respect, the invention is based on the knowledge that it has proved to be safe in practice if the conveying helix, even during any slight jamming, rotates slightly relative to the drilling head or the mounting shank. This rotated position cannot generally affect unimpeded drilling-dust removal so that a positive-locking connection between conveying helix and drilling head is not imperative. On the contrary, when helices made in particular of plastic are used, the crucial factor is that sudden loading of the helix is to be avoided as far as possible during jamming or tilting, i.e. the helix should immediately disengage without a time lag during stressing of this type. However, according to the invention, this is only possible with a conveying helix which fully slips immediately and does not first have to be axially displaced. The connection between the conveying helix and the drilling head has therefore been made as a frictional-resistance connection, in which arrangement no significant axial displacement occurs between the conveying helix and the drilling head. On the contrary, the supporting spring now has the other task of achieving an adequate contact force of the conveying helix relative to the drilling head so that the conveying helix does not fully slip in normal operation. Tests have shown that this type of connection is adequate in practice, this advantage being thus associated with extremely careful treatment of the conveying helix.

The bearing surface between conveying helix and drilling head can be designed so as to be flat, conical or even arched. The latter has the advantage that a larger bearing surface and thus better frictional resistance is ensured.

To improve the frictional resistance, it can be convenient and advantageous for the contacting bearing surfaces between conveying helix and drilling head to be roughened. The roughening can, for example, be designed as a type of fluting. Furthermore, better frictional resistance can be achieved by the additional application of a friction lining or by an additional friction disk.

Furthermore, it is advantageous that the spring force of the supporting spring and thus of the frictional resistance is made to be adjustable. This can be achieved, for example, by the supporting ring being adjustable in its axial position. Supporting springs of different hardness can also be used.

Further features and advantages essential to the invention are obtained from the following exemplary embodiments described in greater detail with reference to the drawings, in which:

BRIEF DESCRIPTION OF THE DRAWINGS

FIG. 3a shows a third embodiment of the invention, similar to FIG. 2a;

FIG. 3b shows a fourth embodiment of the invention similar to FIG. 3a; and

DETAILED DESCRIPTION OF THE PREFERRED EMBODIMENTS

Figure 1:
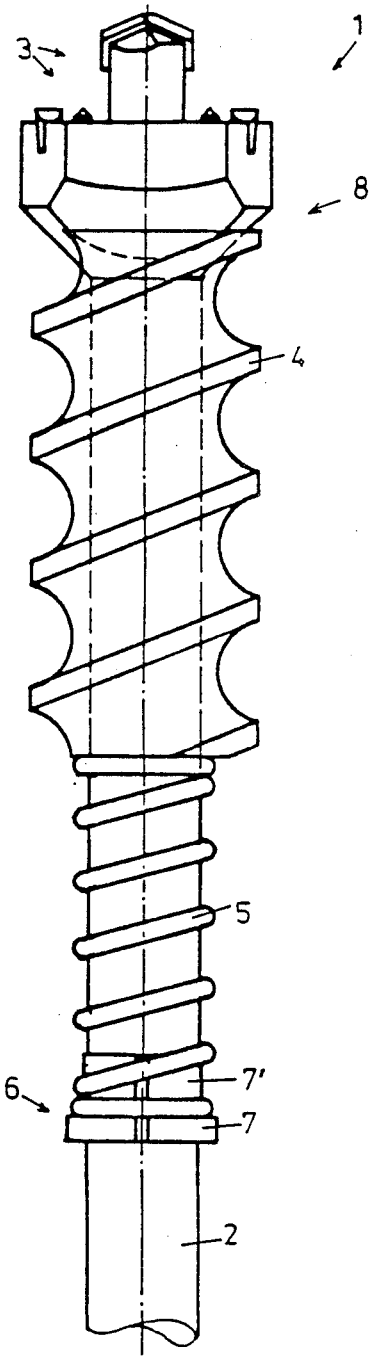
FIG. 1 shows a side view of the drilling tool according to the invention.

The drilling tool 1 shown in FIG. 1 consists of a drill shank 2 and a drilling head 3 which is designed, for example, as a cross drill bit as disclosed, for example, by German Offenlegungsschrift 3,426,977. The slip-on and interchangeable conveying helix 4 is designed as a plastic slip-on helix profiled from the solid, i.e. the conveying helix has its own drill helix profile. Solid plastic helices of this type are known, for example, from DE 3,614,010.4A1.

Instead of the solid plastic helix 4, a wound conveying helix can also be used provided it addresses the same problem as is addressed by the invention.

The conveying helix 4 is defined at the bottom in the axial direction by the supporting spring 5, the longitudinally supporting spring being supported on a supporting ring 6. The supporting ring 6 consists of a radially expandable, longitudinally slotted supporting sleeve 7 which can be snapped into a turn groove in the drill shank 2, the lower part of the supporting spring 5, to block the radial expansion of the supporting sleeve, surrounding an upper supporting sleeve area 7'.

The supporting spring 5 has the same winding direction as the conveying helix 4 so that additional conveying action can be obtained for drilling dust.

Figure 2A:
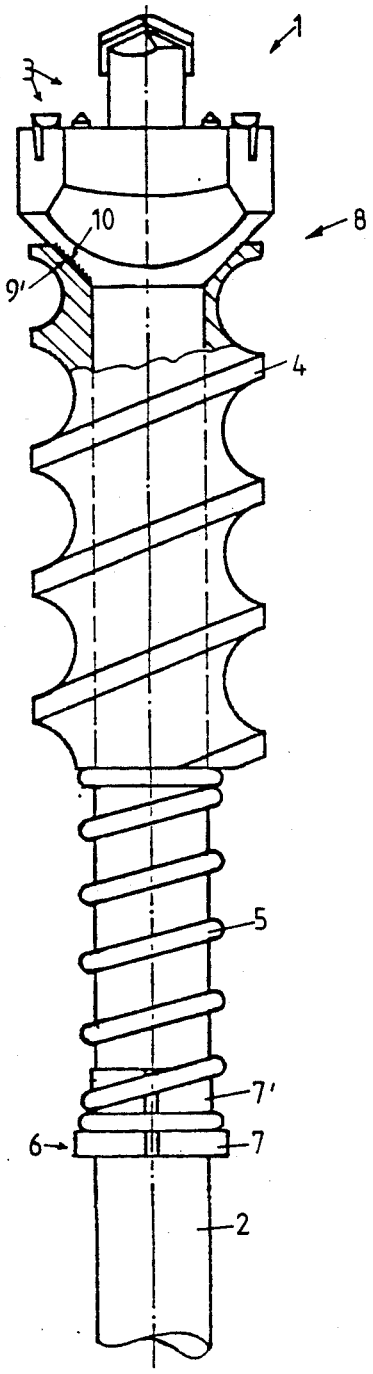
FIG. 2*a* shows a sectional representation of the connection between conveying helix and drilling head in a first embodiment.
Figure 2B:
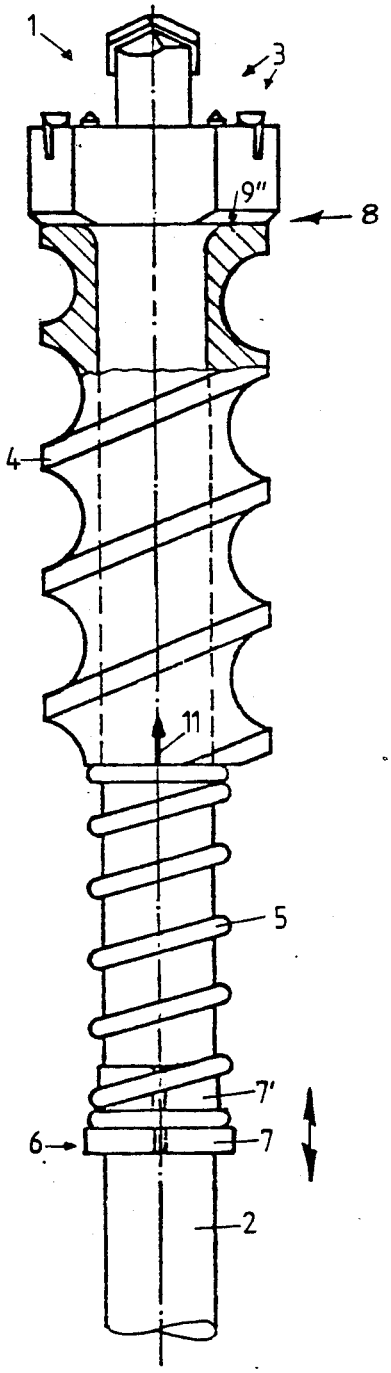
FIG. 2b shows a partially sectional representation of second embodiment of the contact surface of the invention.
Figure 3A:
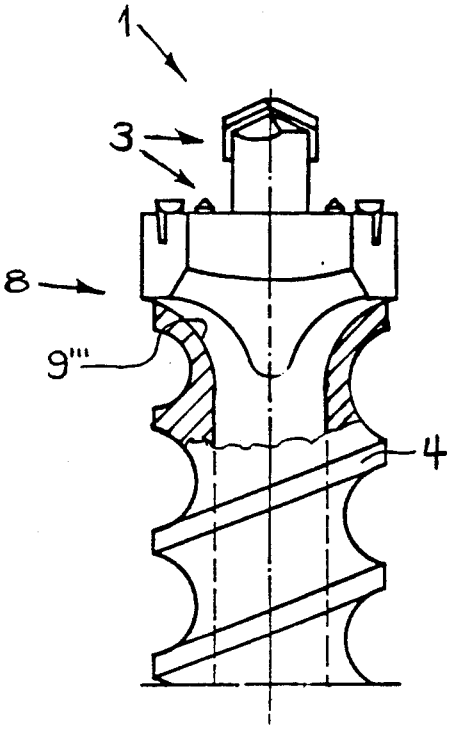
Figure 3B:
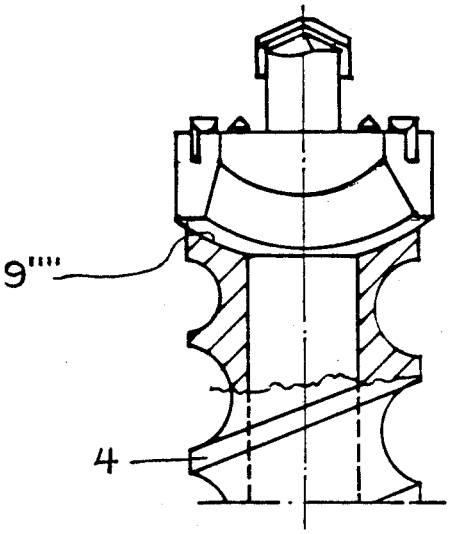
Figure 4:
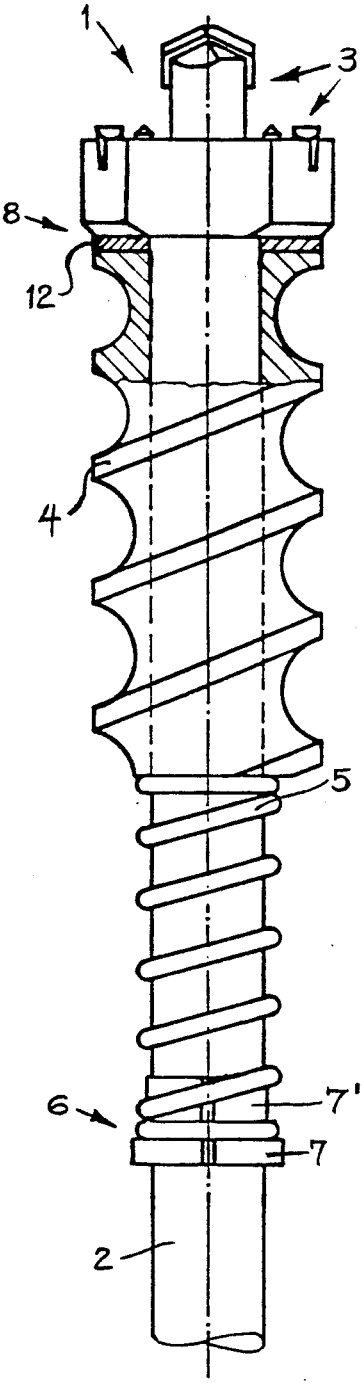
FIG. 4 shows a still further partially sectional embodiment of the invention.

As apparent from FIG. 2a in sectional representation, the conveying helix 4, in its upper area 8, is axially supported by means of a frictional-resistance connection at the contact surface 9. Here, in FIG. 2a, as an alternative embodiment, the drilling tool is shown as having a conical or truncated-cone-shaped contact surface 9'. FIG. 2b shows the embodiment which has a flat contact surface 9''. The conical design of the contact surface 9' has the advantage of a greater connecting area and thus an increased frictional-resistance action. Contact surfaces 9''' and 9'''' surface can also be of arched design as shown in the third and fourth embodiments of FIGS. 3a and 3b. The mutual contact surfaces 9 between conveying helix 4 and drilling head 3 are conveniently roughened, as best seen in FIG. 2a. For this purpose, a type of fluting 10 is schematically indicated in the left hand half of FIG. 2a. Another type of roughening can also be used to increase the friction moment, e.g. in the form of an adhesive or a friction lining adhesively bonded or sprayed on. Also, as seen in FIG. 4, showing a still further embodiment, an additionally incorporated friction disk 12 can be used.

The supporting spring 5, with a certain contact force or spring 11, presses the conveying helix 4 toward the drilling head 3. During normal loading of the drilling tool, this results in a frictional-resistance connection between conveying helix 4 and drilling head 3, thus ensuring that the conveying helix 4 is reliably driven along in a rotating manner on the drill shank 2. The contact spring force 11 can be changed by varying the spring hardness of the supporting spring 5. This would be ensured, for example, by axial displacability or adjustability of the supporting ring 6 as indicated by the arrow in FIG. 2b or by springs 5 of different strength.

The jamming action is described in European Patent 0,264,657 which is a counterpart to U.S. Pat. No. 4,852,670, and to Federal Republic of Germany Offenlegungsschrift 3,635,538. This occurs in particular when making apertures in fissured rock.

As soon as the conveying helix 4 in the drilling tool according to the invention jams, the frictional-resistance connection between conveying helix 4 and drilling head 3 can be released by slight axial displacement so that damage to the conveying helix is impossible. As soon as the jamming between conveying helix and drilled hole has been released, the supporting spring 5, via the contact spring force 11, again pushes the conveying helix 4 to a sufficient extent against the drilling head 3 so that a frictional-resistance connection is created at the various contact surfaces 9', 9'', 9''', and 9''''.

What is claimed is:

1. A drilling tool comprising:
a drill shank having first and second ends;
a drill head at said first end of said drill shank;
an interchangeable conveying helix disposed between said drill head and said second end of said drill shank, said conveying helix including a friction forming contact surface for axially supporting said drill head;
a spring supporting device attached to said drill shank at a location remote from said first end; and
a spring disposed between said conveying helix and said spring supporting device and pre-loading said conveying helix for forcing the contact surface of said helix against said drill head for frictionally engaging said helix and said drill head.

2. A drilling tool as in claim 1, wherein said contact surface is substantially conical in cross section.

3. A drilling tool as in claim 1, wherein said contact surface is substantially flat in cross section.

4. A drilling tool as in claim 1, wherein said contact surface is substantially arched in cross section.

5. A drilling tool as in claim 1, wherein said contact surface has fluting for roughening the surface for enhancing the frictional engagement.

6. A drilling tool as in claim 1, further comprising means for varying the spring force for varying the frictional engagement between said contact surface and said conveying helix.

7. A drilling tool as in claim 1, further comprising friction lining means disposed on said contact surface for enhancing the frictional engagement between said contact surface and said conveying helix.

8. A drilling tool as in claim 7, wherein said friction lining means is an adhesive bonded to said contact surface.

9. A drilling tool as in claim 7, wherein said friction lining means is an adhesive sprayed on said contact surface.

10. A drilling tool as in claim 7, wherein said friction lining means is a friction disk disposed between said contact surface and said conveying helix.

* * * * *